US009132994B2

(12) United States Patent
Ferchaud

(10) Patent No.: US 9,132,994 B2
(45) Date of Patent: Sep. 15, 2015

(54) METHOD FOR LOADING OVERSIZED MERCHANDISE ONTO A CONTAINER SHIP

(76) Inventor: Eric Ferchaud, Sainte Adresse (FR)

( * ) Notice: Subject to any disclaimer, the term of this patent is extended or adjusted under 35 U.S.C. 154(b) by 0 days.

(21) Appl. No.: 13/695,928

(22) PCT Filed: May 3, 2011

(86) PCT No.: PCT/EP2011/057068

§ 371 (c)(1),
(2), (4) Date: Nov. 2, 2012

(87) PCT Pub. No.: WO2011/138335

PCT Pub. Date: Nov. 10, 2011

(65) Prior Publication Data

US 2013/0051970 A1 Feb. 28, 2013

(30) Foreign Application Priority Data

May 4, 2010 (FR) ..... 10 53464

(51) Int. Cl.
*B66C 1/16* (2006.01)

(52) U.S. Cl.
CPC . *B66C 1/16* (2013.01); *Y10T 403/70* (2015.01)

(58) Field of Classification Search
CPC ..... B66C 1/16
USPC ..... 414/803, 139.4, 141.3, 141.6, 141.7, 414/142.6, 142.7, 142.8; 220/1.5; 224/524, 224/529, 532, 533, 537; 254/4 R
See application file for complete search history.

(56) References Cited

U.S. PATENT DOCUMENTS

| | | | | |
|---|---|---|---|---|
| 3,459,326 | A * | 8/1969 | Betjemann | 220/1.5 |
| 3,591,033 | A * | 7/1971 | Partridge | 220/1.5 |
| 3,690,485 | A * | 9/1972 | Fischer et al. | 414/416.12 |
| 4,008,916 | A | 2/1977 | Ide | |
| 4,128,267 | A * | 12/1978 | Niblett et al. | 294/81.56 |
| 5,170,901 | A * | 12/1992 | Bersani | 220/1.5 |
| 5,184,929 | A * | 2/1993 | Reynolds | 414/10 |
| 5,267,648 | A | 12/1993 | Baker | |
| 5,522,633 | A * | 6/1996 | Massi | 294/81.52 |
| 6,027,291 | A * | 2/2000 | Sain et al. | 410/35 |

(Continued)

FOREIGN PATENT DOCUMENTS

| | | | | |
|---|---|---|---|---|
| DE | 41 38 882 A1 | | 6/1993 | |
| EP | 1932718 | * | 6/2008 | B60P 3/10 |

(Continued)

OTHER PUBLICATIONS

Ferchaud, Eric, Machine generated translation of EP 1932718, Jun. 2008.*

*Primary Examiner* — Saul Rodriguez
*Assistant Examiner* — Lynn Schwenning
(74) *Attorney, Agent, or Firm* — Sughrue Mion, PLLC

(57) ABSTRACT

The invention relates to a standardized platform (1) equipped with two beams (11, 11') which are transverse relative to its front end and its rear end. The transverse beams extend beyond the lateral edges of the platform, such that the ends of these beams can receive slings (24*a*-24*d*) which allow the assembly to be secured to hoisting and handling means of containers.

It is thus possible to transport goods (21) which are both wider and longer than a standardized platform (1), on this platform (1). The goods can therefore be handled and loaded by means of hoisting and handling means for containers, i.e. for a cost which is reduced in comparison with oversized transport.

10 Claims, 3 Drawing Sheets

(56) References Cited

U.S. PATENT DOCUMENTS

| | | | | |
|---|---|---|---|---|
| 6,647,913 | B2 * | 11/2003 | Brignolio | 114/344 |
| 6,991,274 | B2 * | 1/2006 | Brooks | 294/81.51 |
| 7,011,479 | B2 * | 3/2006 | Sain | 410/46 |
| 2003/0202863 | A1 * | 10/2003 | Stansbury et al. | 414/137.1 |
| 2007/0256589 | A1 * | 11/2007 | Bell | 105/355 |

FOREIGN PATENT DOCUMENTS

| | | | |
|---|---|---|---|
| FR | 2 835 515 | A1 | 8/2003 |
| JP | 56-097287 | U | 8/1981 |

* cited by examiner

METHOD FOR LOADING OVERSIZED MERCHANDISE ONTO A CONTAINER SHIP

CROSS REFERENCE TO RELATED APPLICATIONS

This application is a National Stage of International Application No. PCT/EP2011/057068 filed May 3, 2011, claiming priority based on French Patent Application No. 10 53464 filed May 4, 2010, the contents of all of which are incorporated herein by reference in their entirety.

BACKGROUND OF THE INVENTION

The maritime transport of many goods is assured by means of so-called container ships which can transport standardized containers which are stacked on one another on the ship.

This method of transport makes it possible in particular to reduce the costs significantly: since the containers have standardized dimensions, they can be placed on top of one another such as to form a compact assembly.

These standardized containers which are parallelepiped comprise on each of their upper tops a hooking base, which makes it possible to manoeuver them on a loading terminal using standardized hoisting and handling means.

These hoisting means, of the crane type or the like, comprise a mobile ceiling unit equipped with four hooking units, each of which is engaged in a corresponding hooking base of the container in order to grasp the container then handle it.

In addition, a container of this type also comprises on each top of its lower surface a hooking base which can be rendered integral with a hooking base of an upper surface of a container on which it is placed. One base is rendered integral with another by means of a removable lock. The containers are thus stacked whilst being attached to one another, which makes it possible to assure that they are transported in satisfactory conditions of safety, and for a significantly reduced cost.

When the goods to be transported have a height which is greater than that of a container, it is possible to secure these goods to a platform in order to load this platform on the ship by placing it on a container to which it is then attached.

Specifically, a platform of this type has a rectangular form with the same dimensions as a container in plan view, and it is equipped at the tops of its upper surface and of its lower surface with hooking bases of the same type as those which equip the containers. A platform of this type can thus be handled like a container, i.e. by using hoisting and handling means of the same type as those used for the containers.

Thus, a platform of this type makes it possible to transport on a container ship goods which are too wide, too long or too high to be accommodated in a container.

However, when the goods to be transported are both wider and longer than the platform, it is no longer possible to use a platform of this type, since the hooking units of the tops of its upper surface are no longer accessible by the hoisting means once these goods have been secured to the platform.

Specifically, it is thus not possible to handle a platform of this type if it is supporting goods which are both too wide and too long.

In practice, goods of this type must therefore form the basis of so-called oversized transport, by being stowed for example in the hold of a cargo ship, which is detrimental with reference to both the volume which is actually monopolized in the cargo ship, and the handling cost.

OBJECT OF THE INVENTION

The object of the invention is to provide a solution which makes it possible to eliminate this disadvantage.

BRIEF DESCRIPTION OF THE INVENTION

For this purpose, the object of the invention is a process for loading goods on a container ship, comprising the steps of:

- providing a rectangular platform of the type comprising at the level of each of its tops a hooking base which makes it possible to render the platform integral with a container of the same dimensions, on which this platform is designed to be installed;
- attaching to this platform at least two beams with dimensions which are sufficient for each beam end to be situated beyond the rectangular contour of the platform;
- installing the goods on the support constituted by the platform equipped with the beams;
- placing above the assembly constituted by the support and the goods which it bears a container hoisting and handling device ceiling unit, this ceiling unit comprising four hooking units and being positioned such that each hooking unit is plumb with a base of the platform;
- connecting the ceiling unit to the assembly constituted by the support and the goods which it bears by means of four slings, each of which has one end secured to the ceiling unit and another end secured to a beam end;
- maneuvering the hoisting and handling device in order to lift the assembly and deposit it on a container;
- attaching the assembly to this container.

It is thus possible to transport goods which are both wider and longer than a standardized platform, on this platform. The goods can therefore be handled and loaded by means of hoisting and handling means for containers, i.e. for a cost which is reduced in comparison with oversized transport.

The invention also relates to a process as previously defined, wherein the slings are attached to the ceiling unit by means of hooking units of the ceiling unit.

The invention also relates to a process as previously defined, wherein the beams are attached to the upper surface of the platform, and more specifically to the upper surfaces of two consecutive bases of the platform. Optionally, one beam is attached to the front end of the platform, and one beam is attached to the rear end of the platform, each beam being oriented transversely relative to the platform.

The object of the invention is also a beam comprising a longitudinal body comprising two ends, an upper wall and a lower wall, characterized in that the beam comprises at least two bases on the upper wall, and at least two locking units on the lower surface, and, at least at each end, a hoisting ring and a protective plate, perpendicular to the body of the beam.

The beam can also comprise two bases which are separated from one another along this beam by a distance corresponding to the length which separates two bases of the platform which are situated at each end of a small side of the platform.

The object of the invention is also a beam as previously described, comprising at each of its ends at least one hoisting ring.

Finally, the beam can comprise at each of its ends a plate which is oriented according to a direction which is at right-angles to the beam, each plate having dimensions which are greater than the cross section of the beam, so that this beam is resting on the sections of these plates when it is supported on the ground.

DETAILED DESCRIPTION OF THE INVENTION

The idea on which the invention is based is to use a standardized platform, by attaching two transverse beams to its front end and to its rear end. These beams extend beyond the lateral edges of the platform, and the ends of these beams receive slings in order to secure the assembly to means for hoisting and handling of containers.

Figure 1:
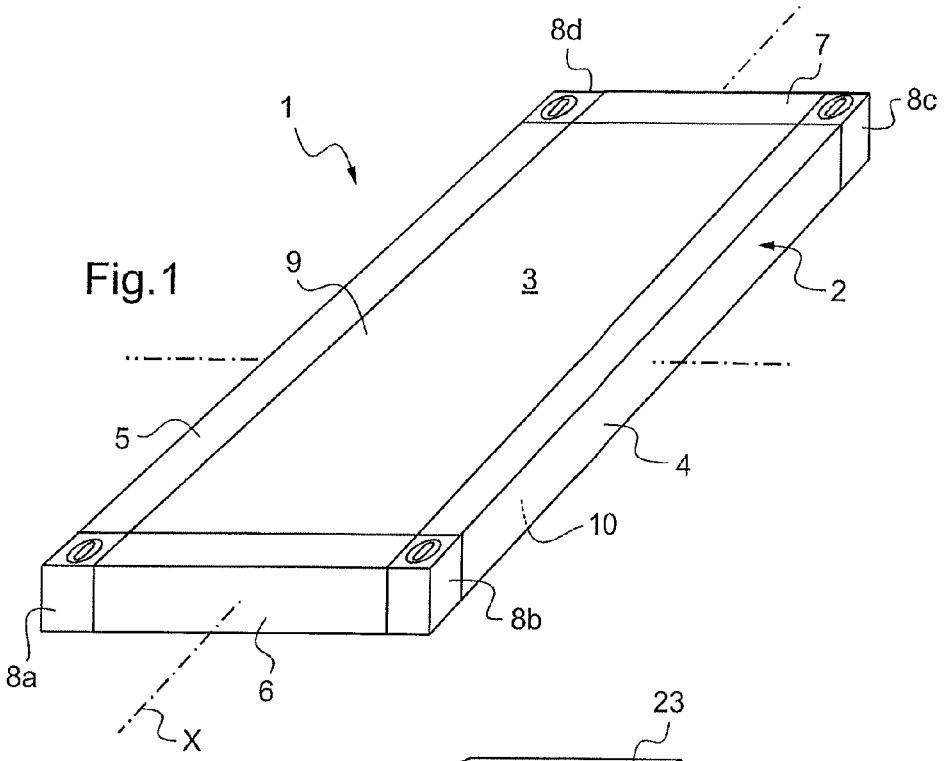
FIG. 1 is a general view of a platform.

A platform of this type which is represented in FIG. 1 and has the reference 1 comprises a rectangular steel frame 2 surrounding a parallelepiped central core 3 which can be made of wood. This platform has dimensions corresponding to those of a standardized container, such as to be able to be attached to the upper surface of a container of this type.

The frame 2 is formed by two side members 4 and 5, and by two cross members 6 and 7 in the form of profiles with a cross section in the form of a "U" which are welded to one another such as to surround the periphery of the core 3. Each top of this frame incorporates a hooking base, these four bases having the references 8*a* to 8*d*.

Each base 8*a*-8*d* substantially comprises a first oblong opening which is oriented according to the longitudinal direction X of the platform 1 and opens into an upper surface 9 of this platform, and a second oblong opening which is oriented according to the longitudinal direction X and opens into a lower surface 10.

The platform 1 is designed to be able to be rendered integral with a container by means of its lower surface 10, by using four removable locks of the type described in patent document WO2005095157. Each removable lock is then interposed between a base of the upper surface of the container and a corresponding base of the platform 1, in order to render the bases integral with one another.

According to the invention, two beams which are oriented transversely relative to the direction X are attached to the front end 6 and the rear end 7 of the upper surface 9 of this platform 1.

Figure 2:
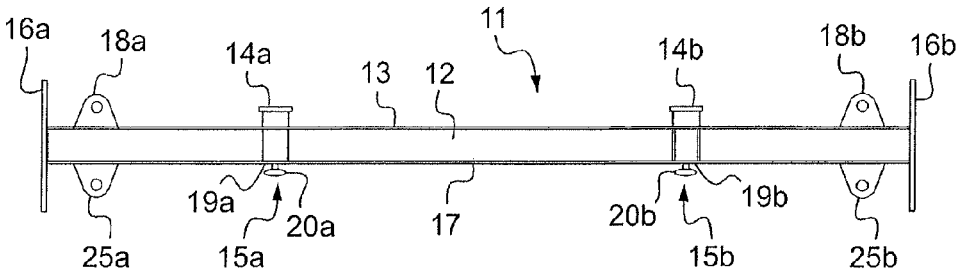
FIG. 2 is a front view of a beam according to the invention.
Figure 3:
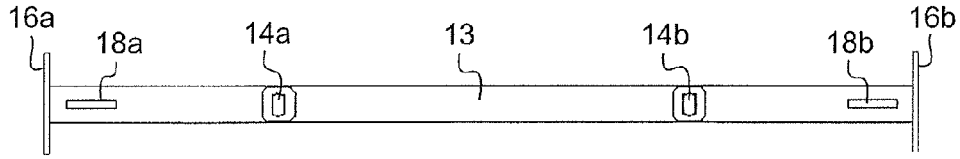
FIG. 3 is a plan view of the beam according to the invention.

A beam of this type which is represented in FIGS. 2 and 3 and has the reference 11 is in this case formed by a profile in the form of an "I". It comprises a longitudinal body 12 comprising two ends, an upper wall 13 comprising two bases 14*a* and 14*b*, and a lower wall 17 comprising two locking units 15*a* and 15*b*.

This beam 11 comprises two hoisting rings 18*a* and 18*b* at each of its ends on the upper wall 13, and two other hoisting rings 25*a* and 25*b* at each of its ends on the lower wall 17, as well as square protective plates 16*a* and 16*b* which are perpendicular to the beam body, and constitute the termination of each end.

The beam 11 comprises on its lower wall 17 two locking units 15*a* and 15*b* which are separated from one another along this beam by a distance corresponding to the distance which separates two consecutive hooking bases of a single small side of the platform, such as, for example, the bases 8*a* and 8*b*, or the bases 8*c* and 8*d*.

Each locking unit 15*a*, 15*b* comprises a parallelepiped bottom 19*a*, 19*b* which is attached to the lower wall 17 of the beam 11, and is provided with a rotary knob which extends from this bottom, these knobs having the references 20*a* and 20*b* respectively.

Each knob 20*a*, 20*b* has a form which allows it to be engaged in a corresponding opening in a base 8*a*-8*d* of the platform 1, and can pivot round an axis which is at right-angles to the surface of the bottom from which it extends. For this purpose, each locking unit 15*a*, 15*b* also comprises a maneuvering lever or the like, not represented, which makes it possible to make the rotary knob pivot in the bottom, between an unlocked position and a locked position.

In the free position, each knob 20*a*, 20*b* extends perpendicularly to the beam body, and in the locked position each knob 20*a*, 20*b* extends parallel to the beam body, as in FIG. 2.

This beam 11 also comprises two bases 14*a*, 14*b*, of the same type as the bases which equip the containers, and extend from its upper surface, these two bases 14*a* and 14*b* being situated at right-angles to the locking units 15*a* and 15*b* respectively. Each base 14*a*, 14*b* comprises a metal cube which is welded onto the beam 11, this cube comprising at the level of its upper wall an opening with an oblong form which is compatible with the removable locks, i.e. which can receive a knob.

This beam is symmetrical relative to a plane which is situated between its ends, and extends transversely relative to the general direction of the beam body. The bases 14*a* and 14*b* are arranged symmetrically relative to the median plane. The same applies to the locking units 15*a* and 15*b*.

The locking units 15*a*, 15*b* of the beam 11 make it possible to render the beam integral directly with two consecutive bases of a small side of a platform, such as, for example, the bases 8*a* and 8*b*. This operation is assured by firstly placing the knobs 20*a*, 20*b* of the two hooking units of the beam in the unlocked position by means of maneuvering levers, not represented.

The beam 11 is then grasped by means of a hoisting device, and is placed plumb with the small side 6 of the platform 1, such that the knobs 20*a*, 20*b* are situated at right-angles to the corresponding bases 8*a* and 8*b*. The lifting device is then controlled in order to lower the beam 11 onto the platform 1, until it is resting on the latter, the knobs 20*a*, 20*b* then being engaged in the openings 8*a* and 8*b*.

The levers or actuators of the two hooking units 15*a*, 15*b* are then maneuvered in order to place them in the locked position, so as to attach this beam 11 completely to the platform 1.

Figure 4:
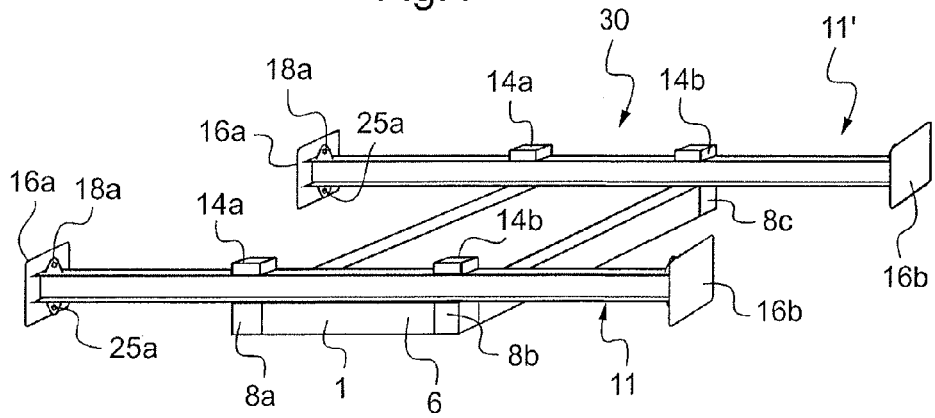
FIG. 4 is a general view in perspective of the platform equipped with two beams according to the invention.

A second beam, which has the reference 11', and is identical to the beam 11, is then attached to the opposite small side 7 of the platform 1, i.e. to its rear end, in order to constitute an assembly which forms a support with the reference 30, represented in FIG. 4. This assembly comprises the platform 1 equipped with the beam 11 attached to the upper surface of its front end 6, and with the beam 11', which is identical, but is attached to the upper surface of the rear end 7 of this platform 1.

As can be seen in this FIG. 4, the two beams 11 and 11' extend perpendicularly to the longitudinal direction X of the platform 1, their respective ends being situated laterally beyond this platform 1, the locking units of each beam 11, 11' being locked in the corresponding bases of the platform 1.

Figure 7:
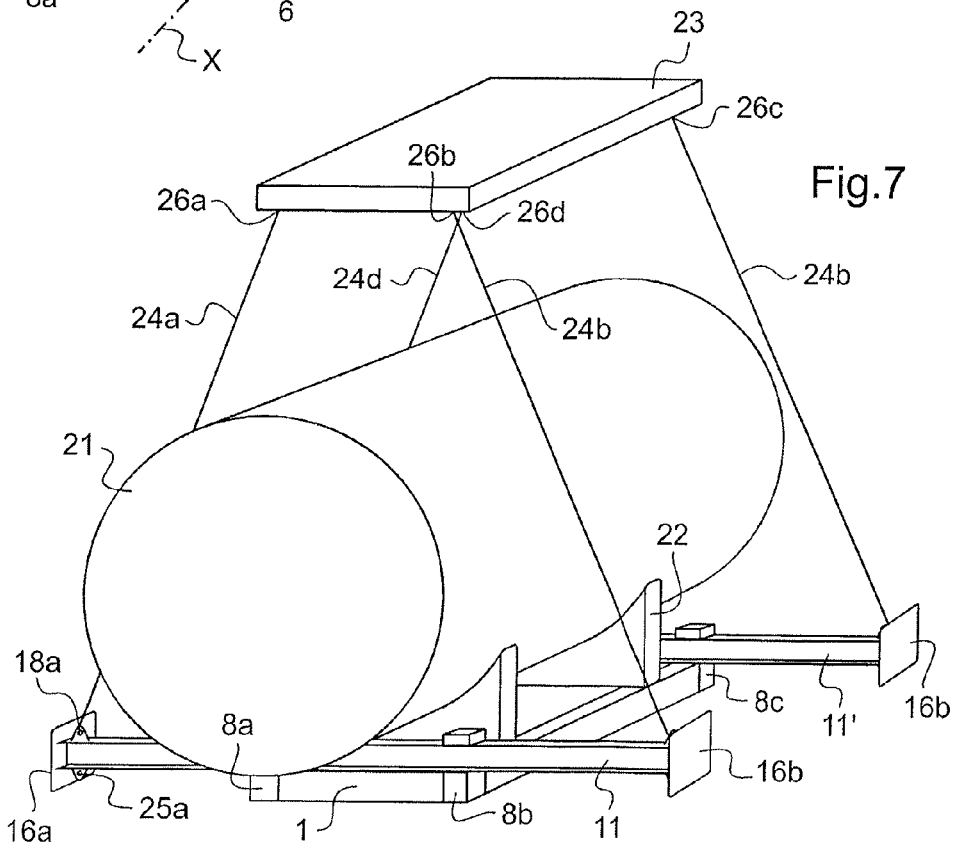
FIG. 7 is a view in perspective showing an intermediate stage of the process according to the invention.
Figure 5:
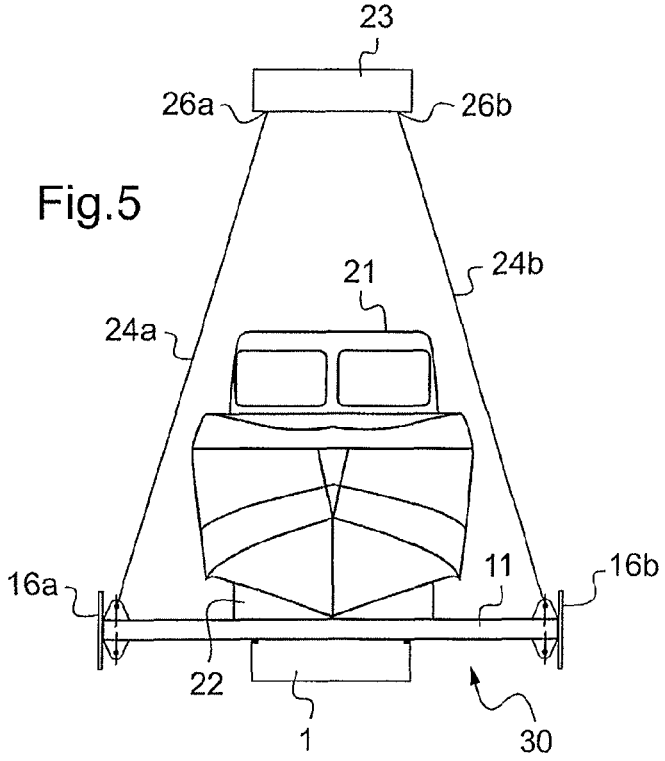
FIG. 5 is a general view of a loading operation according to the invention.
Figure 6:
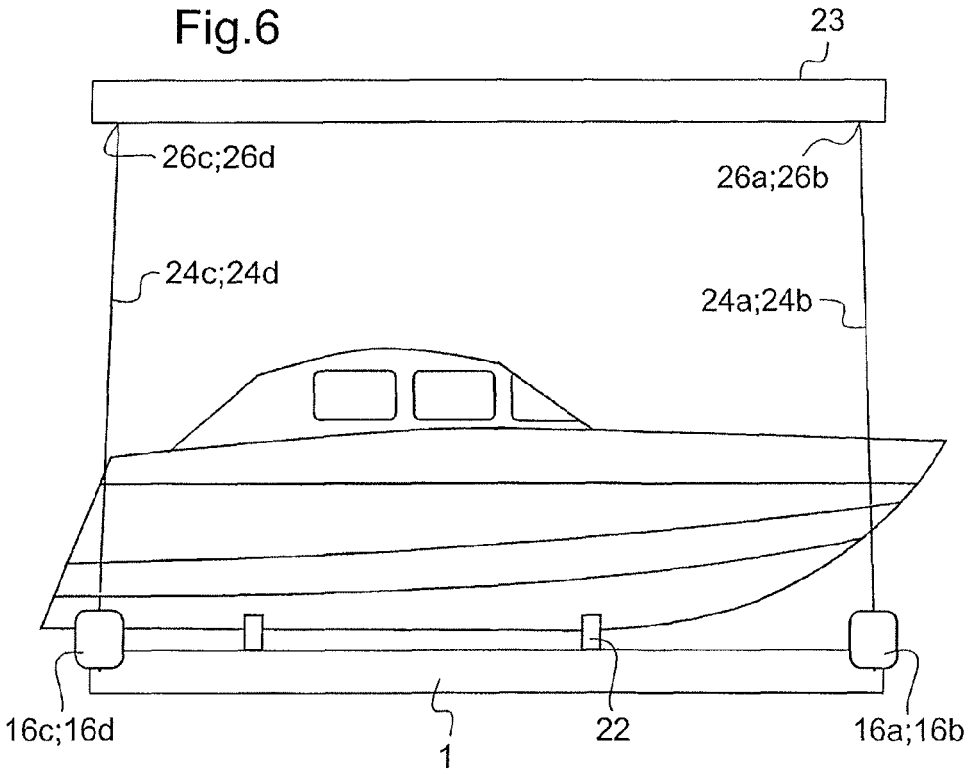
FIG. 6 is a lateral view showing an intermediate stage of the process according to the invention.

FIGS. 5 to 7 illustrate the use of the support 30 in order to handle goods 21 with a length and width greater than the length and width of the platform. These goods, which are installed on the platform by means of plinths 22, can for example consist of a pleasure boat as in FIGS. 5 and 6, or a tank or a cylinder as in the example in FIG. 7.

A ceiling unit 23 of a container hoisting and handling device is then positioned above the support 30 on which the goods 21 are installed, at right-angles to the platform 1. This ceiling unit 23 constitutes a container grasping unit, and for this purpose it comprises four hooking units with the references 26*a* to 26*d*, which are arranged according to the same arrangement as the hooking bases of a container or a platform.

In other words, the hooking units of the ceiling unit 23 are situated at each top of a rectangle, such as to engage in the corresponding bases of a container or platform upper surface.

At this stage, four slings 24*a*-24*d* which can be seen in FIG. 7, and are provided with loops at their ends, are installed in order to render the ceiling unit 23 integral with the assembly. Each sling is attached by means of a first end to one of the four rings 18*a*, 18*b* situated at the ends of each beam 11, 11', and by means of its other end to a hooking unit of the ceiling unit 23.

The slings can have their upper end hooked directly on a hooking unit of the ceiling unit 23, or by means of an additional element. Each upper sling end can also be attached to the ceiling unit 23 by means of a shackle engaged in a ring of the ceiling unit 23 situated in the vicinity of the hooking unit, a ring of this type being able to be offset for example by approximately ten centimeters or more relative to the hooking unit.

The beams 11 and 11' have lengths which are greater than the width of the platform and of the goods 21 transported, so that once the slings 24*a*-24*d* have been hooked on, they do not interfere with the goods 21. The beam 11, the slings 24*a* and 14*b* and the ceiling unit 23 form respectively the base, the sides and the top of a trapezium in front view according to FIG. 4.

The assembly is then lifted by raising the ceiling unit 23, and is deposited on a container which acts as a base, and is previously placed in the container ship. The support 30 is attached on the base container using removable locks previously placed on hooking bases of the upper surface of the base container. The slings 24*a*-24*d* are then detached from the rings 18*a*-18*b* and are brought back down to the ground for further use.

In the example in the figures, the assembly is suspended from the ceiling unit 23 by means of slings. A sling means any means which makes it possible to suspend the assembly from the ceiling unit 23, such as, for example, ropes, straps, chains or cables.

Optionally, the assembly constituted by the support 30 and the goods 21 is prepared on a so-called setting-up area situated at a certain distance from the container ship. This assembly is transferred to the loading area equipped with the container hoisting and handling device, this transfer being assured for example by means of a gantry crane or travelling means.

In the example which has been described, each beam 11, 11' is attached to the platform 1 directly by means of the hooking units which equip this beam. However, it is also possible to attach one and/or the other beam to the platform 1 by means of the hooking bases 14*a*, 14*b* which equip these beams, by using removable locks, not represented, which are firstly attached to the corresponding bases of the platform 1. A removable lock of this type typically comprises a parallelepiped bottom which is provided with two rotary knobs on its opposite surfaces.

The beam is then placed at right-angles to the removable locks installed on the bases of the platform, such that the two bases of this beam are at right-angles to the two locks. The beam is then lowered onto the locks so that the upper knobs of these locks engage in the attachment bases of the beam.

The removable locks are then actuated by an operator in order to go into the locked position, such as to render the beam completely integral with the platform.

The beam 11 also comprises rings 25*a* and 25*b* on the lower wall 17 which are identical to the hoisting rings 18*a* and 18*b* of the upper wall 16, and make it possible to use the beam 11 once it has been turned round. In this configuration, the beam is rotated by 180° relative to its longitudinal axis so that the bases 14*a* and 14*b* face the ground. The beam 11 can then be attached by means of the bases 14*a* and 14*b* on the upper surface 9 of the platform 1 by means of removable locks. Thus, if the hooking units 15*a* or 15*b* become damaged, the beam 11 could be used according to the process previously described.

In the example in the figures, the ends of the slings 24*a*-24*d* are attached directly to the hooking units of the ceiling unit 23, but they can also be attached to the ceiling unit 23 by means of complementary elements attached to the hooking units of the ceiling unit 23.

As far as the protective plates 16*a*, 16*b* which constitute the ends of each beam end are concerned, these protect the rings 18*a*, 18*b*, the bases 14*a*, 14*b* and the locking units 15*a*, 15*b* which equip the beam, when this beam is deposited on the ground.

For this purpose, these protective plates 16*a*, 16*b* have dimensions which are sufficient such that, with the beam 11 placed on the ground supported on the sections of the protective plates 16*a*, 16*b*, the different elements which equip this beam are spaced away from the ground.

The invention claimed is:

1. A method for loading goods on a container ship, comprising:

providing a rectangular platform having a length and a width that define a rectangular contour and having four corners;

providing at a level of each of said four corners of the rectangular platform, a hooking base, said hooking base being structured to render the rectangular platform integral with a container, having at least said length and width, when the rectangular platform is installed on the container;

attaching to said rectangular platform at least two beams having beam ends and having dimensions sufficient for each said beam end to be situated beyond the rectangular contour of the rectangular platform;

installing the goods on a support, comprising the rectangular platform with the beams attached, to form an assembly;

placing above the assembly a container hoisting and handling device ceiling unit, said ceiling unit comprising four ceiling hooking units and being positioned such that each ceiling hooking unit is plumb with a base of the rectangular platform;

connecting the ceiling unit to the assembly by means of four slings, each sling having two sling ends, one sling end of each sling being secured to the ceiling unit and another sling end being secured to a beam end;

maneuvering the ceiling unit in order to lift the assembly and deposit said assembly on the container; and attaching the assembly to the container and detaching the slings to move away the ceiling unit.

2. The process as claimed in claim 1, wherein each sling end is attached to the ceiling unit while being rendered integral with a hooking unit of said ceiling unit or with a ring of said ceiling unit.

3. The process as claimed in claim 1, wherein each beam is attached to an upper surface of the rectangular platform.

4. The process as claimed in claim 1, wherein each beam is attached to the upper surfaces of two consecutive bases of the platform.

5. The process as claimed in claim 1, wherein one beam is attached to a front end of the rectangular platform, and another beam is attached to a rear end of the platform, each beam being oriented transversely relative to the rectangular platform.

6. The process as claimed in claim 2, wherein each beam is attached to bases of the rectangular platform by means of removable locks.

7. A beam designed for implementation of a method for loading goods on a container ship by providing a rectangular platform having a length and a width that define a rectangular contour and having four corners, providing at a level of each of said four corners of the rectangular platform, a hooking base, said hooking base being structured to render the rectangular platform integral with a container, having at least said length and width, when the rectangular platform is installed on the container, attaching to said rectangular platform at least two beams having beam ends and having dimensions sufficient for each said beam end to be situated beyond the rectangular contour of the rectangular platform, installing the goods on a support, comprising the rectangular platform with the beams attached, to form an assembly, placing above the assembly a container hoisting and handling device ceiling unit, said ceiling unit comprising four ceiling hooking units and being positioned such that each ceiling hooking unit is plumb with a base of the rectangular platform, connecting the ceiling unit to the assembly by means of four slings, each sling having two sling ends, one sling end of each sling being secured to the ceiling unit and another sling end being secured to a beam end, maneuvering the ceiling unit in order to lift the assembly and deposit said assembly on the container, and attaching the assembly to the container, said beam comprising:

at least two beam hooking units which are separated from one another along said beam by a distance corresponding to a length which separates two bases situated at each end of the width of the rectangular platform, said beam hooking units being operative to attach the beam directly to the two bases of the rectangular platform, the beam having ends each provided with means for attaching a sling thereto.

8. The beam as claimed in claim 7, additionally comprising two bases which are separated from one another along said beam by a distance corresponding to the width of the rectangular platform.

9. The beam as claimed in claim 7, comprising at each of its ends at least one hoisting ring.

10. The beam as claimed in claim 7, comprising at each of said ends a plate which is oriented according to a direction which is at right-angles to the beam, each plate having dimensions which are greater than a cross section of the beam, so that said beam is resting on sections of said plates when said beam is supported on the ground.

* * * * *